US011398688B2

(12) United States Patent
Imperato et al.

(10) Patent No.: US 11,398,688 B2
(45) Date of Patent: Jul. 26, 2022

(54) PLUG-IN CONNECTOR WITH A HANDLE PART

(71) Applicant: Tyco Electronics France SAS, Pontoise (FR)

(72) Inventors: Andre Imperato, Oullins (FR); Yannick Villardier, Mions (FR); Damien Lacoste, Lyons (FR)

(73) Assignee: Tyco Electronics France SAS, Pontoise (FR)

( * ) Notice: Subject to any disclaimer, the term of this patent is extended or adjusted under 35 U.S.C. 154(b) by 39 days.

(21) Appl. No.: 16/909,385

(22) Filed: Jun. 23, 2020

(65) Prior Publication Data

US 2020/0412032 A1 Dec. 31, 2020

(30) Foreign Application Priority Data

Jun. 28, 2019 (EP) ..... 19305870

(51) Int. Cl.
*H01R 9/26* (2006.01)
*H01H 85/32* (2006.01)
(Continued)

(52) U.S. Cl.
CPC ..... *H01R 9/2683* (2013.01); *H01H 85/32* (2013.01); *H01H 85/54* (2013.01); *H01R 9/265* (2013.01);
(Continued)

(58) Field of Classification Search
CPC .... H01R 9/2683; H01R 13/50; H01R 13/465; H01R 9/2675; H01R 9/265; H01H 85/54; H01H 85/32
See application file for complete search history.

(56) References Cited

U.S. PATENT DOCUMENTS 5,700,986 A * 12/1997 Rurup ..... H01R 9/2683 200/50.32
6,052,059 A 4/2000 Jaeger
(Continued)

FOREIGN PATENT DOCUMENTS

DE 102004017179 A1 10/2005
DE 102005050267 A1 4/2007
(Continued)

OTHER PUBLICATIONS

Extended European Search Report, App No. 19305870, dated Dec. 19, 2019, 12 pages.

*Primary Examiner* — Oscar C Jimenez
*Assistant Examiner* — Paul D Baillargeon
(74) *Attorney, Agent, or Firm* — Barley Snyder

(57) ABSTRACT

A plug-in connector cooperating with a terminal block includes a body having a cooperation assembly mechanically securing the plug-in connector on the terminal block, the body having a compartment accommodating a fuse element, a pair of plug contacts received within the compartment, and a handle part having an actuating portion and a linking portion. The plug contacts are each connected to a terminal of the fuse element. Each of the plug contacts has a contact tongue extending outside of the compartment, the contact tongue electrically secured to a bus bar of the terminal block. The linking portion is attached to the body and extends along a linking axis parallel to an insertion axis of a pin of the cooperation assembly. The actuating portion has an actuating surface extending transversely to the insertion axis and cooperating with a marking element disposed along the actuating surface.

20 Claims, 3 Drawing Sheets

(51) Int. Cl.
*H01H 85/54* (2006.01)
*H01R 13/46* (2006.01)
*H01R 13/50* (2006.01)

(52) U.S. Cl.
CPC ..... *H01R 9/2675* (2013.01); *H01R 13/465* (2013.01); *H01R 13/50* (2013.01)

(56) References Cited

U.S. PATENT DOCUMENTS

| | | | | |
|---|---|---|---|---|
| 7,658,653 | B2 * | 2/2010 | Diekmann | H01H 85/2045 439/715 |
| 9,058,752 | B2 * | 6/2015 | Ganster | G09F 3/04 |
| 2008/0248698 | A1 | 10/2008 | Pizzi | |

FOREIGN PATENT DOCUMENTS

| | | | |
|---|---|---|---|
| EP | 2355251 | A1 | 8/2011 |
| EP | 3425742 | A1 | 1/2019 |

* cited by examiner

PLUG-IN CONNECTOR WITH A HANDLE PART

CROSS-REFERENCE TO RELATED APPLICATION

This application claims the benefit of the filing date under 35 U.S.C. § 119(a)-(d) of European Patent Application No. 19305870.8, filed on Jun. 28, 2019.

FIELD OF THE INVENTION

The present invention relates to a plug-in connector and, more particularly, to a plug-in connector with a handle part.

BACKGROUND

A plug-in connector for a fuse element can be equipped with a handle part to enable plugging or unplugging it from terminal blocks. Such handles, to be easily maneuverable, should have a sufficient size even when the plug-in connector is small. This, however, implies geometrical constraints that can be difficult to deal with as other elements such as markings or a light indicator could also be necessary for such plug-in connectors.

SUMMARY

A plug-in connector cooperating with a terminal block includes a body having a cooperation assembly mechanically securing the plug-in connector on the terminal block, the body having a compartment accommodating a fuse element, a pair of plug contacts received within the compartment, and a handle part having an actuating portion and a linking portion. The plug contacts are each connected to a terminal of the fuse element. Each of the plug contacts has a contact tongue extending outside of the compartment, the contact tongue electrically secured to a bus bar of the terminal block. The linking portion is attached to the body and extends along a linking axis parallel to an insertion axis of a pin of the cooperation assembly. The actuating portion has an actuating surface extending transversely to the insertion axis and cooperating with a marking element disposed along the actuating surface.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
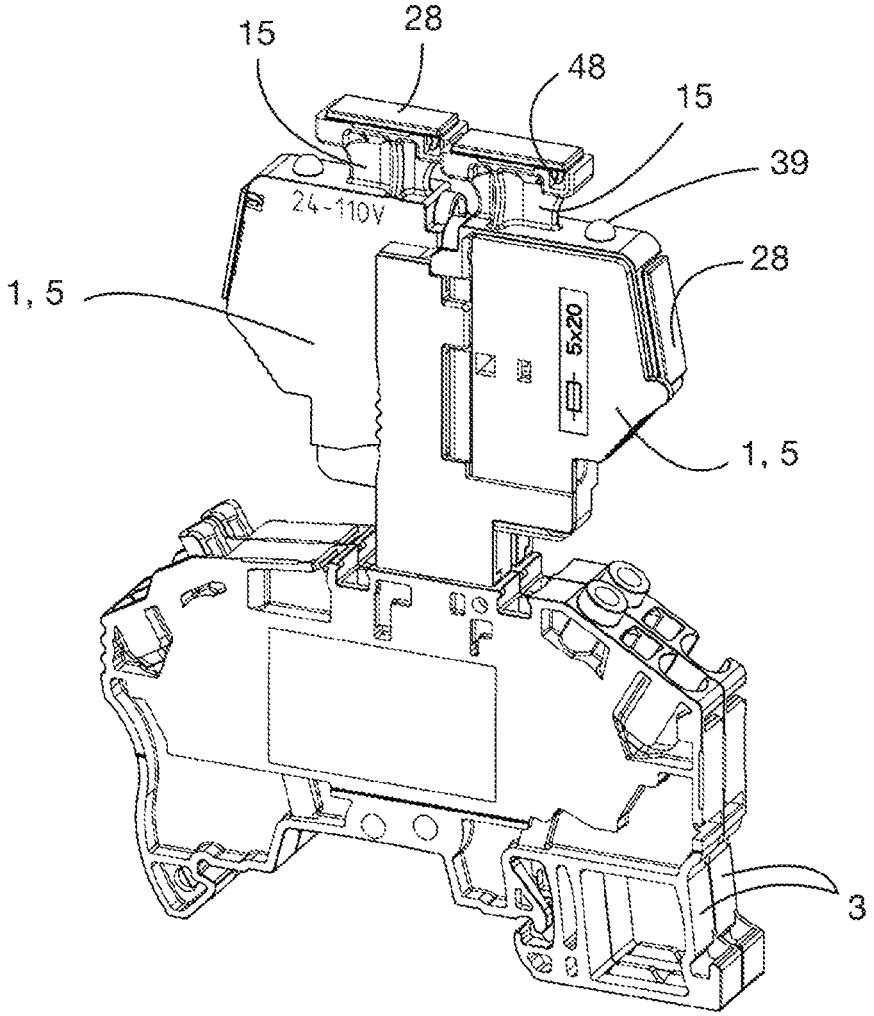
FIG. 1 is a perspective view of a pair of plug-in connectors according to an embodiment of the invention mounted on a pair of adjacent terminal blocks.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the invention to those skilled in the art. The different embodiments described herein that are not incompatible can be combined.

A pair of plug-in or plug connectors 1 according to an embodiment are shown in FIG. 1 cooperating with a pair of adjacent terminal blocks 3. The plug connectors 1 are identical and mounted in reversed positions on their corresponding terminal blocks 3.

Figure 2:
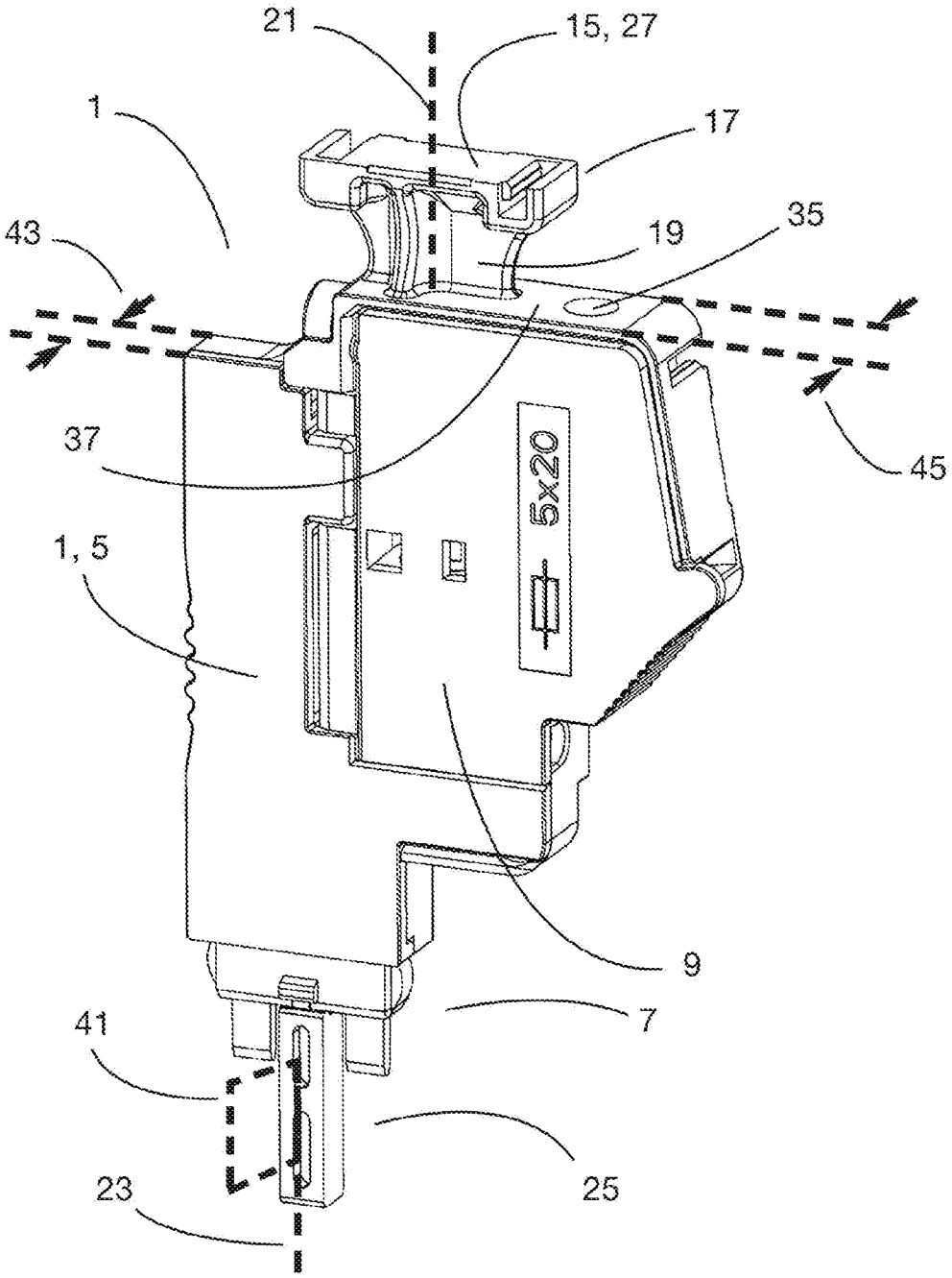
FIG. 2 is a perspective view of a plug-in connector according to an embodiment.
Figure 3:
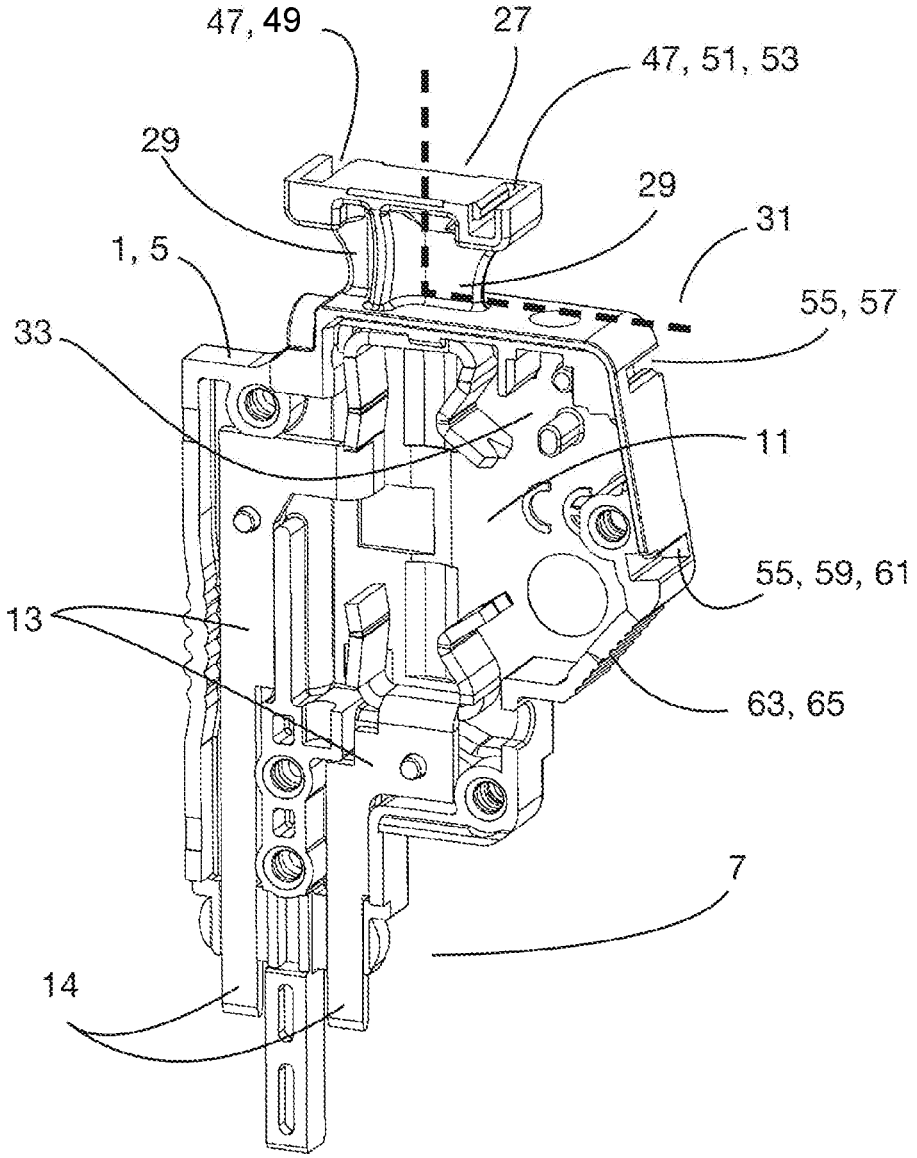
FIG. 3 is a perspective view of the plug-in connector of FIG. 2 without a cover.

The plug connector 1, as shown in FIGS. 1-3, comprises a body 5 including a cooperation assembly 7 configured to mechanically secure the plug-in connector 1 on the terminal block 3 in two reversed mounted positions, as shown in FIG. 1. The body 5 also has a cover 9 that has been removed in FIG. 3. The body 5, as shown in FIG. 3, has a compartment 11 adapted for accommodating a fuse element or other components that have a comparable size and connection function, in particular components that are conductive.

The plug-in connector 1, as shown in FIG. 3, has a pair of plug contacts 13 received within the compartment 11, the two plug contacts 13 being each configured to be connected to a corresponding terminal of the fuse element. Each of the two plug contacts 13 has a contact tongue 14 extending outside the compartment 11, each contact tongue 14 being included in the cooperation assembly 7 and configured to be electrically secured to a corresponding bus bar of the terminal block 3 in the two mounted positions.

The plug-in connector 1, as shown in FIGS. 1 and 2, has a handle part 15 provided with an actuating portion 17 and a linking portion 19, the linking portion 19 being attached to the body 5 and extending along a linking axis 21 that is coincident to or parallel to an insertion axis 23 of a pin 25 of the cooperation assembly 7. The pin 25 is a central pin 25 of the cooperation assembly 7.

The actuating portion 17 presents an actuating surface 27, shown in FIGS. 2 and 3, extending transversely to the insertion axis 23 and being configured to cooperate with a marking element 28 that is disposed along the actuating surface 27, as shown in FIG. 1. The marking element 28 is a label element and, in an embodiment, is a planar label element that is disposed parallel to the actuating surface 27.

The handle part 15, as shown in FIG. 3, has a pair of reinforcing ribs 29 extending in a plane 31 transverse to an extension plane of the actuating surface 27. The handle part 15 forms a "T" shape and the reinforcing ribs 29 are located on right-angled corners of the "T".

As shown in FIG. 3, the compartment 11 includes an arrangement 33 configured for receiving a light indicator, the body 5 having an opening 35 shown in FIG. 2 for viewing the light indicator from outside. The opening 35 is made in a transversal wall 37 of the body 5 on which the linking portion 19 is added, the handle part 15 being outside an area defined in front of the opening 35 according to a direction parallel to the insertion axis 23. The light indicator is arranged for functioning when the fuse has blown. The plug-in connector 1 has the light indicator and the light indicator includes a LED. In an embodiment shown in FIG. 1, the plug-in connector 1 has a translucent light guide 39 located at least partially in the opening 35.

The linking portion 19 is configured to be breakable to limit the longitudinal size of the plug-in connector 1 along the insertion axis 23 if the handle part 15 is no longer needed. To this end, in an embodiment, the linking portion 19 has a strip form configured to be cut.

The cooperation assembly 7 is symmetrical relative to a reversing plane 41, shown in FIG. 2. The insertion axis 23 is such that two reversed mounted positions of the plug connector 1 can be defined by turning the plug connector 1 around the insertion axis 23 according to an angle of 180°. This defines the two geometrical options for plugging the plug connector 1 as shown in FIG. 1.

The body 5, as shown in FIG. 2, has a pair of portions with different widths such that two plug-in connectors 1 mounted on two adjacent terminal blocks 3 in reversed mounted positions with respect to each other present an overall width corresponding to the width of the two terminal blocks 3. The two portions with different widths include a first portion with a first width 43 smaller than and a second portion with a second width 45 larger than a corresponding terminal block 3 width. The sum of the first width 43 and the second width 45 corresponds to the overall width of the two adjacent terminal blocks 3. The second portion is arranged to receive the fuse element, as described above.

The actuating surface 27, as shown in FIGS. 1 and 3, has at least one recess 47 arranged to cooperate with a corresponding lug 48 of the marking element 28 so that the actuating surface 27 is configured as a pushing surface for the thumb when mounting the plug-in connector 1 on the terminal block 3. No element of the actuating portion 17 extends beyond the actuating surface 27 along the insertion axis 23. The at least one recess 47, in the embodiment shown in FIG. 3, has a pair of recesses 47 each presenting a final transverse section 49 opening outside the actuating portion 17 according to opposite directions. The opposite directions are transverse to the insertion axis 23.

The marking element 28, shown in FIG. 1, is configured to be installed on the actuating portion 17 and to be disconnected easily by turning it about an axis parallel to the insertion axis 23. Each recess 47 has another end section 51 opposed to its final transverse section 49, shown in FIG. 3, and that is ended by an abutment 53 made in the actuating portion 17.

The body 5, as shown in FIGS. 1 and 3, has at least one additional recess 55 arranged to cooperate with a corresponding lug 48 of the marking element 28. The at least one additional recess 55 in the shown embodiment includes two additional recesses 55. The two additional recesses 55 each have an additional final transverse section 57 opening outside the body 5 according to additional opposite directions. The additional opposite directions are transverse to the insertion axis 23. Each additional recess 55 has another additional end section 59 opposed to its additional final transverse section 57 and that is ended by an additional abutment 61 made in the body 5.

The two recesses 47 and the two additional recesses 55 are arranged so that two installed marking elements 28 extend transversely relative to each other. Each recess 47 is a groove and each additional recess 55 is an additional groove.

The body 5, as shown in FIG. 3, has a grip member 63 located on an external wall of the body 5 oriented in a different direction than the orientation direction of the actuating surface 27 to enable seizing the plug-in connector 1 by hand. An oriented or orientation direction of a surface is the direction of a normal relative to the corresponding surface. The grip member 63 has a series of parallel ribs 65.

The handle part 15 has a dual purpose. First, it serves as handle that can be used to insert the plug-in connector 1 in the terminal block 3 to reach the mounted position. The user has to push the actuating surface 27 along the insertion axis 23. The actuating portion 17 of the handle can also be grabbed by a user between a forefinger and thumb to withdraw the plug-in connector 1 from the terminal block 3.

Second, the marking element 28 shown in FIG. 1 can be added on the actuating surface 27 without disturbing the functioning of the handle part 15. Indeed, as this part is generally planar, the actuating portion 17 is thicker but has the same geometrical features. Besides, the marking element 28 is well located on the summit of the plug-in connector 1 to be easily visible.

This arrangement allows combining a handle part 15 for a fuse plug and an extra marking area without additional space needed for this marking. In addition, the opening 35 for the light indicator allows the indicator to be easily visible to a user, as the handle part 15 is not hiding it. The terminal blocks 3 that have a lower width than the size of the fuse element can further be used with limited space constraints.

What is claimed is:

1. A plug-in connector configured to cooperate with a terminal block, comprising:

a body having a cooperation assembly configured to mechanically secure the plug-in connector on the terminal block in a mounted position, the body having a compartment adapted for accommodating a fuse element;

a pair of plug contacts received within the compartment, the plug contacts each configured to be connected to a terminal of the fuse element, each of the plug contacts having a contact tongue extending outside of the compartment, the contact tongue included in the cooperation assembly and configured to be electrically secured to a bus bar of the terminal block in the mounted position; and a handle part having an actuating portion and a linking portion, the linking portion attached to the body the actuating portion having an actuating surface extending transversely to the insertion axis and cooperating with a marking element disposed along the actuating surface, the actuating surface having a recess cooperating with a mounting feature of the marking element and the body having an additional recess cooperating with a mounting feature of an additional marking element.

2. The plug-in connector of claim 1, wherein the compartment has an arrangement receiving a light indicator.

3. The plug-in connector of claim 2, wherein the body has an opening for viewing the light indicator from outside of the plug-in connector, the opening disposed in a transversal wall of the body on which the linking portion is attached.

4. The plug-in connector of claim 3, wherein the handle part is outside an area that is in front of the opening in a direction parallel to the insertion axis.

5. The plug-in connector of claim 1, wherein the linking portion is breakable.

6. The plug-in connector of claim 1, wherein the cooperation assembly is symmetrical relative to a reversing plane, a pair of reversed mounted positions of the plug-in connector in the terminal block are defined by rotating the plug-in connector 180° about the insertion axis.

7. The plug-in connector of claim 6, wherein the body has a first portion and a second portion having a width different than the first portion, the width direction being transverse to the direction of extension of the actuating surface.

8. The plug-in connector of claim 7, wherein a pair of plug-in connectors mounted on a pair of adjacent terminal blocks in reversed mounted positions with respect to each other have an overall width corresponding to a width of the adjacent terminal blocks.

9. The plug-in connector of claim 1, wherein the recess is a pair of recesses each having a final transverse section opening outside the actuating portion, the final transverse sections of the pair of recesses open in opposite directions.

10. The plug-in connector of claim 1, wherein the marking element installed in the recess and the additional marking element installed in the additional recess extend transversely relative to each other.

11. The plug-in connector of claim 1, wherein the handle part has a reinforcing rib extending in a plane transverse to an extension plane of the actuating surface.

12. The plug-in connector of claim 1, wherein the body has a grip member on an external wall of the body.

13. The plug-in connector of claim 12, wherein the grip member is oriented in a different direction than an orientation direction of the actuating surface.

14. A plug-in connector configured to cooperate with a terminal block, comprising:

a body having a cooperation assembly configured to mechanically secure the plug-in connector on the terminal block in a mounted position, the body having a compartment adapted for accommodating a fuse element;

a pair of plug contacts received within the compartment, the plug contacts each configured to be connected to a terminal of the fuse element, each of the plug contacts having a contact tongue extending outside of the compartment, the contact tongue included in the cooperation assembly and configured to be electrically secured to a bus bar of the terminal block in the mounted position; and a handle part having an actuating portion and a linking portion, the linking portion attached to the body, the actuating portion having an actuating surface extending transversely to the insertion axis and cooperating with a marking element disposed along the actuating surface, the actuating surface having a pair of recesses cooperating with mounting features of the marking element, the recesses each having a final transverse section opening outside the actuating portion, the final transverse sections of the pair of recesses opening in opposite directions.

15. The plug-in connector of claim 14, wherein the body has an additional recess cooperating with a mounting feature of an additional marking element.

16. A plug-in connector configured to cooperate with a terminal block, comprising:

a fuse body having a cooperation assembly configured to mechanically secure the plug-in connector on the terminal block in a mounted position, the body having a first portion and a second portion having a width different than the first portion in a direction transverse to an insertion axis of the cooperation assembly, the cooperation assembly is symmetrical relative to a reversing plane;

a pair of plug contacts received within the compartment, the plug contacts each configured to be connected to a terminal of the fuse element, each of the plug contacts having a contact tongue extending outside of the compartment, the contact tongue included in the cooperation assembly and configured to be electrically secured to a bus bar of the terminal block in the mounted position; and a handle part having an actuating portion and a linking portion, the linking portion attached to the body and extending along a linking axis parallel to the insertion axis of the cooperation assembly, the actuating portion having an actuating surface extending transversely to the insertion axis for receiving a marking element, the width of the body being defined transversely to the direction of extension of the actuating surface.

17. The plug-in connector of claim 16, wherein a pair of reversed mounted positions of the plug-in connector in the terminal block are defined by rotating the plug-in connector 180° about the insertion axis.

18. The plug-in connector of claim 17, wherein with a pair of plug-in connectors mounted on a pair of adjacent terminal blocks in the reversed mounted positions, the first and second portions of differing widths correspond in orientation such that the pair of plug-in connectors have an overall width corresponding to a total width of one of the first portions and one of the second portions of one of the bodies.

19. The plug-in connector of claim 18, wherein the fuse element is arranged in the second portion of the body.

20. The plug-in connector of claim 16, wherein the linking portion and the actuating portion are arranged completely over the body in the direction of the insertion axis.

* * * * *